United States Patent [19]

Ohtsuka

[11] Patent Number: 4,544,261

[45] Date of Patent: Oct. 1, 1985

[54] CHARGING AND EXPOSURE SECTION IN AN ELECTROPHOTOGRAPHIC APPARATUS

[75] Inventor: Shuichi Ohtsuka, Ashigarakami, Japan

[73] Assignee: Fuji Photo Film Co., Ltd., Kanagawa, Japan

[21] Appl. No.: 611,882

[22] Filed: May 18, 1984

[30] Foreign Application Priority Data

May 24, 1983 [JP] Japan ..... 90102

[51] Int. Cl.[4] ..... G03G 15/04

[52] U.S. Cl. ..... 355/3 CH; 355/72; 250/326

[58] Field of Search ..... 355/3 R, 3 CH, 72–74, 355/112; 250/326, 324

[56] References Cited

U.S. PATENT DOCUMENTS 3,942,080 3/1976 Milewski ..... 250/326 X 3,991,311 11/1976 Plumadore ..... 250/326

4,041,312 8/1977 Plumadore ..... 250/326 X

OTHER PUBLICATIONS

*IBM Tech. Disc. Bull.*, "Charge Corona Edge Shield", vol. 15, No. 7, Dec. '72, p. 2060.

*Primary Examiner*—Richard L. Moses

[57] ABSTRACT

In a charging and exposure section of an electrophotographic apparatus, a charging mask defining a charge area of an electrophotosensitive member charged by a charging unit is formed with a cut-out portion which is not exposed through an objective lens focusing the image of a picture carried by an original onto the electrophotosensitive member, so as to form a retrieval mark on a portion of the electrophotosensitive member. This retrieval mark is utilized for judging the condition of exposure on the electrophotosensitive member or for facilitating the picture image quality control.

3 Claims, 3 Drawing Figures

CHARGING AND EXPOSURE SECTION IN AN ELECTROPHOTOGRAPHIC APPARATUS

BACKGROUND OF THE INVENTION

1. Field of the Invention

This invention relates to a charging and exposure section in an electrophotographic apparatus intended for facilitating provision of retrieval marks, detection of the condition of exposure and control of the quality of recorded picture images.

2. Description of the Prior Art

An electrophotosensitive member is a laminate formed by coating a layer of an electrical conductive material on a base of an electrical insulating material and then coating a layer of a photoconductive, electrical insulating material on the conductive layer. It is one of advantages of an electrophotographic apparatus utilizing such an electrophotosensitive member for recording that recorded picture image data can be readily reproduced. Also, because of such a property of the electrophotosensitive member to have no sensitivity to light before being charged, the electrophotographic apparatus of the kind above-described is advantageous in many aspects over a conventional recording system using the known silver halide photosensitive material for recording, and it is finding many practical applications in various fields making the most of these advantages.

However, prior art electrophotographic apparatus proposed hitherto have been defective in that, in the recording of picture image data on electrophotosensitive members, the condition of charging and development tends to be subject to a change when, for example, the toner is deteriorated, the charging unit is fouled or the power supply voltage fluctuates. This is because, in such an event, the condition of recording picture image data on the electrophotosensitive members cannot be maintained constant, resulting in a non-uniform quality of reproduced picture images. Thus, even when the picture image data may not be reproduced in the optimum mode due to, for example, mal-operation or failure of either the charging unit, exposing unit or developing unit, the apparatus operator who is not aware of the presence of such trouble will continue the recording operation on one electrophotosensitive member after another.

On the other hand, in the case of utilization of the electrophotosensitive member as a microfilm capable of carrying records of many data thereon, it is convenient to record a retrieval mark corresponding to each of the recorded data on the electrophotosensitive member. According to one of the known methods for recording such a retrieval mark on the electrophotosensitive member, a marking corresponding to this retrieval mark is formed on, for example, a table supporting an original, so that this marking is recorded together with the information of the original on the electrophotosensitive member. However, according to the above method, there is a possibility that the marking is hidden by the original and cannot be recorded due to the carelessness of the apparatus operator. Therefore, it is customary to previously print the retrieval mark on the electrophotosensitive member. In such a case, an additional step of printing the retrieval marks on the electrophotosensitive member is required, resulting in a defect that the cost of the elctrophotosensitive member increases inevitably. Further, because of the fact that the retrieval marks are printed at intervals of a pre-set constant distance therebetween, the interval between the retrieval marks does not match the interval between recorded picture image data when the electrophotosensitive member is used in another electrophotographic apparatus in which the size of frames and the interval between the frames are different from the present interval between the retrieval marks.

SUMMARY OF THE INVENTION

With a view to obviate the aforementioned various defects of the prior art electrophotographic apparatus, it is a primary object of the present invention to provide a charging and exposure section of an electrophotographic apparatus which can record a retrieval mark without fail during recording of picture image data and in which the retrieval mark can be utilized for the judgement of the picture image quality and also for the detection of mal-operation or failure of the charging unit, exposing unit or developing unit so as to ensure recording of the picture images with uniform quality.

In accordance with the present invention which attains the above object, there is provided a charging and exposure section of an electrophotographic apparatus comprising an objective lens focusing the image of a picture carried by an original placed on a supporting table onto an electrophotosensitive member, a charging means disposed between the objective lens and the electrophotosensitive member for charging the electrophotosensitive member, an exposure mask disposed between the charging means and the electrophotosensitive member for defining an exposure area of the electrophotosensitive member, and a charging mask disposed between the exposure mask and the electrophotosensitive member for defining a charge area of the electrophotosensitive member, the charging mask having a cut-out portion extending outward beyond a marginal edge of the exposure mask.

DETAILED DESCRIPTION OF THE PREFERRED EMBODIMENTS

A preferred embodiment of the charging and exposure section of the electrophotographic apparatus according to the present invention will now be described in detail.

Figure 1:
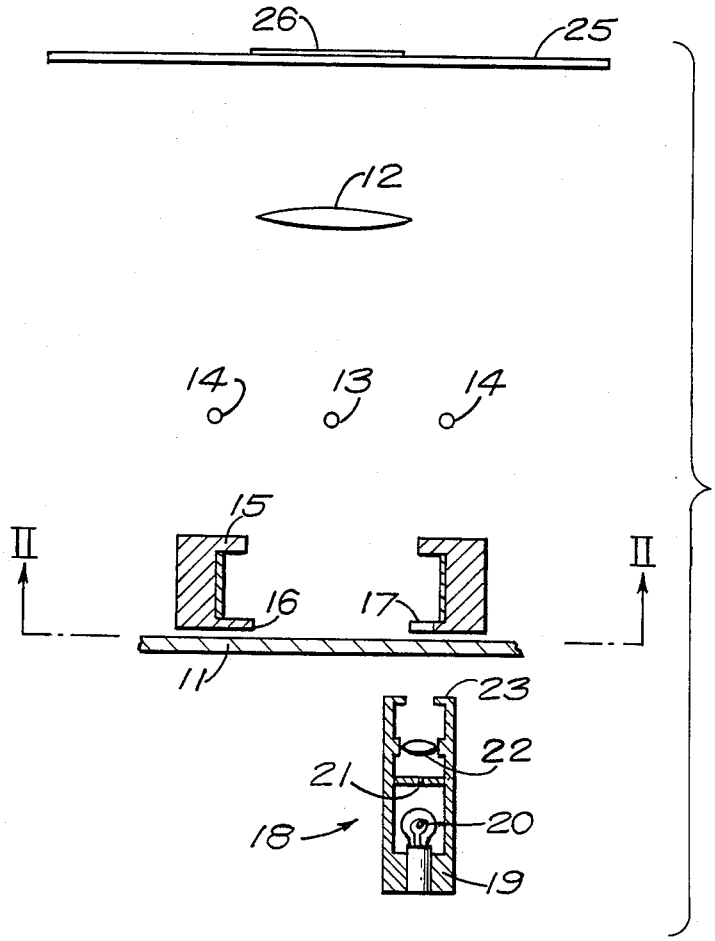
FIG. 1 is a sectional view showing schematically the structure of a preferred embodiment of the charging and exposure section of the electrophotographic apparatus according to the present invention.
Figure 2:
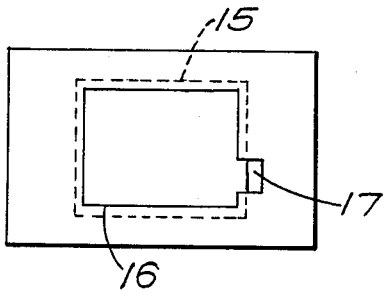
FIG. 2 is a plane view when viewed along the line II—II in FIG. 1.

Referring to FIGS. 1 and 2, the image of a picture carried by an original 26 placed on a supporting table 25 is focused by an objective lens 12 onto an electrophotosensitive member 11. A corona wire 13 and a pair of grounded electrodes 14 are disposed between the objective lens 12 and the electrophotosensitive member 11 for charging the member 11. Between the corona wire 13 and the electrophotosensitive member 11, an exposure mask 15 is disposed to define the area of the electrophotosensitive member 11 to be exposed through the objective lens 12. Between this exposure mask 15 and the electrophotosensitive member 11, a charging mask 16 of rectangular shape is disposed in close proximity to the electrophotosensitive member 11 to define the area of the electrophotosensitive member 11 to be charged by the corona wire 13. Although the area of the region to be charged (which area will be referred to hereinafter as the charge area) is shown to be smaller than that of the region to be exposed (which area will be referred to hereinafter as the exposure area) in the illustrated embodiment, it is apparent that the former may be selected to be equal to or larger than the latter. As best shown in FIG. 2, the charging mask 16 has a cut-out portion 17 extending outward beyond a marginal edge of the exposure mask 15. Therefore, the portion of the electrophotosensitive member 11 corresponding to this cut-out portion 17 of the charging mask 16 is necessarily charged.

As is commonly known, corona ions do not always make a straight advance and tend to migrate while passing around an edge of an obstacle. Accordingly, the electrophotosensitive member 11 is charged in a pattern corresponding to the space pattern of the charging mask 16 disposed adjacent to the electrophotosensitive member 11, so that the portion of the electrophotosensitive member 11 corresponding to the cut-out portion 17 which is shaded from the corona wire 13 by the exposure mask 15 can also be charged. For a similar reason, the exposure mask 15 will exhibit its masking function even when it may be disposed at a position remote from the electrophotosensitive member 11. On the other hand, the charging mask 16 is required to be disposed in contact with or very close to the electrophotosensitive member 11. It is also desirable that the charging mask 16 be formed of a strip of an electrical-insulating synthetic resin or of a strip of a conductive material biased to have a potential approximately equal to the surface potential of the electrophotosensitive member 11.

A retrieval-mark exposure unit 18 capable of exposing the portion of the electrophotosensitive member 11 corresponding to the cut-out portion 17 of the charging mask 16 is disposed opposite to the cut-out portion 17 with the electrophotosensitive member 11 interposed therebetween. This exposure unit 18 is composed of a casing 19, a light source 20, a pinhole 21 forming a beam of parallel light rays for exposure, a collimetor lens 22, and a mask 23 masking an exposure area which is about one-half the area of the cut-out portion 17 in the illustrated embodiment. Although the cut-out portion 17 is formed as an integral part of the charging mask 16 in the illustrated embodiment, it may be formed independently of or separately from the charge area.

When the corona discharge from the corona wire 13 occurs, the zone of the electrophotosensitive member 11 including the charge area defined by the charging mask 16 and the area defined by its cut-out portion 17 is uniformly charged. Then, when the image of the picture carried by the original 26 is focused by the objective lens 12 onto the surface of the electrophotosensitive member 11, the charges accumulating on the portions of the zone exposed to light are neutralized or disappear. However, due to the fact that the portion of the electrophotosensitive member 11 corresponding to the cut-out portion 17 shielded against light by the exposure mask 15 is maintained in the charged state, a toner image corresponding to the pattern of this cut-out portion 17 can be formed by the subsequent developing and fixing process, so that it also can serve as a retrieval mark used for counting the frame position. In this case, exposure by the retrieval-mark exposure unit 18 is preferably done at the same time. This exposure can selectively provide a retrieval mark which is the combination of the two kinds of retrieval marks of different sizes. Provision of such a retrieval mark is convenient for the sorting of recorded picture image data. That is, when a pattern corresponding to the kind of originals is formed through the cut-out portion 17 during exposure, retrieval of originals of a specific kind can be easily achieved by optically detecting the retrieval marks. From such a viewpoint, the shape and size of the mask 23 of the exposure unit 18 are preferably arranged to be variable so that a plurality of kinds of retrieval marks can be selectively formed on the electrophotosensitive member 11.

According to the present invention, the retrieval mark is formed on the portion of the electrophotosensitive member 11 corresponding to one frame each time a picture image data is recorded thereon, so that the frame having the retrieval mark recorded thereon can be detected to be the one which has been exposed. Also, by measuring the toner concentration of the retrieval mark and controlling the charging and developing units to maintain constant the toner concentration, the quality of picture images can be maintained high. On the other hand, any failure or mal-operation of the charging unit and/or the developing unit can also be detected by such a manner of control. Further, since the mark is printed during exposure of each frame, the mark corresponding to each of the frames can be reliably provided even if the frame pitch might be changed. Although the charging unit of corona discharge type is referred to by way of example, it is apparent that the charging unit may be any one of other known types.

Figure 3:
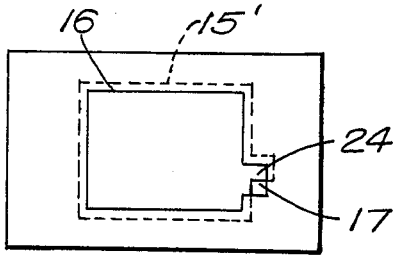
FIG. 3 is a view similar to FIG. 2 but showing a partial modification of the embodiment shown in FIG. 1.

FIG. 3 shows the concept of another embodiment of the present invention which is a partial modification of FIG. 1. Referring to FIG. 3, a cut-out portion 24 partly overlapping the cut-out portion 17 of the charging mask 16 is formed in an exposure mask 15', and a portion of standard means of optical reflection density such as a reference white sheet and etc. (not shown) used as a reference for discrimination of the concentration of a picture carried by an original 26 placed on the table 25 is focused onto a portion of the electrophotosensitive member 11 corresponding to the cut-out portion 17 of the charging mask 16. This arrangement permits discrimination of the state of exposure by the objective lens 12. In this case, the area subjected to charging only, the area subjected to charging and exposure of the standard means, and the area not subjected to charging are formed on the electrophotosensitive member 11. Therefore, by optical measurement of the relative concentrations of these areas, whether or not the individual parts of the electrophotographic process operate trouble-free can be reliably checked.

It will be understood from the foregoing detailed description that, in the charging and developing section of the electrophotographic apparatus according to the present invention, a cut-out portion extending outward beyond a marginal edge of the exposure region defined by the exposure mask is formed in the charging mask defining the charge area, so that a retrieval mark can be automatically formed or printed on an electrophotosensitive member each time a picture image data is recorded on the member. The present invention is advantageous in that such a retrieval mark can also be utilized for maintaining the high quality of recorded picture images or for detecting any failure or mal-operation of the components by measuring the toner concentration of this retrieval mark. In the present invention, a retrieval-mark exposure unit capable of changing the shape and size of the retrieval mark is additionally disposed opposite to the cut-out portion of the charging mask. The present invention is therefore further advantageous in that recorded picture image data can be very conveniently sorted and retrieved.

I claim:

1. A charging and exposure section of an electrophotographic apparatus comprising an objective lens focusing the image of a picture carried by an original placed on a supporting table onto an electrophotosensitive member, a charging means disposed between said objective lens and said electrophotosensitive member for charging said electrophotosensitive member, an exposure mask disposed between said charging means and said electrophotosensitive member for defining an exposure area of said electrophotosensitive member, and a charging mask disposed between said exposure mask and said electrophotosensitive member for defining a charge area of said electrophotosensitive member, said charging mask having a cut-out portion extending outward beyond a marginal edge of said exposure mask.

2. A charging and exposure section as claimed in claim 1, wherein standard means of optical reflection density serving as a reference for discrimination of the concentration of the picture is also disposed on said table, and said exposure mask is formed with a cut-out portion partly overlapping said cut-out portion of said charging mask for exposing a portion of said standard means on the portion of said electrophotosensitive member corresponding to said cut-out portion of said charging mask.

3. A charging and exposure section as claimed in claim 1 or 2, wherein a retrieval-mark exposure unit is disposed opposite to said cut-out portion of said charging mask with said electrophotosensitive member interposed therebetween for exposing at least a portion of said charge area of said electrophotosensitive member corresponding to said cut-out portion of said charging mask.

* * * * *